US005743158A

United States Patent [19]

Perkins

[11] Patent Number: 5,743,158

[45] Date of Patent: Apr. 28, 1998

[54] HAND WRENCHING TOOL FOR REMOVING TORQUE LIMITED FASTENERS

[75] Inventor: Leland M. Perkins, Thousand Oaks, Calif.

[73] Assignee: Omega Technologies Inc., Thousand Oaks, Calif.

[21] Appl. No.: 717,002

[22] Filed: Sep. 20, 1996

[51] Int. Cl.[6] ..... B25B 13/28

[52] U.S. Cl. ..... 81/58.5; 81/98

[58] Field of Search ..... 81/92, 94, 97–99, 81/111, 119–121.1, 186, 424.5, 58.5, 53.2, 124.3–124.5, 124.7, 125.1

[56] References Cited

U.S. PATENT DOCUMENTS

| | | | |
|---|---|---|---|
| 282,768 | 8/1883 | Pollard . | |
| 417,652 | 12/1889 | Smith | 81/98 |
| 450,676 | 4/1891 | Newman | 81/98 |
| 651,574 | 6/1900 | Meredith . | |
| 658,850 | 10/1900 | Jones | 81/98 |
| 701,462 | 6/1902 | Bettmann . | |
| 715,900 | 12/1902 | Thompson . | |
| 834,799 | 10/1906 | Hartigan | 81/98 |
| 1,380,822 | 6/1921 | Mason . | |
| 1,754,717 | 4/1930 | Hughens . | |
| 3,161,090 | 12/1964 | McLellan | 81/120 X |
| 3,241,409 | 3/1966 | Raptis . | |
| 3,757,614 | 9/1973 | Evans et al. | 81/119 |
| 4,840,094 | 6/1989 | Macor | 81/124.5 X |
| 4,854,198 | 8/1989 | Batten . | |
| 5,531,141 | 7/1996 | Gilbert | 81/424.5 X |

FOREIGN PATENT DOCUMENTS

| | | | |
|---|---|---|---|
| 1958614 | 5/1971 | Germany . | |
| 2022610 | 11/1971 | Germany . | |
| 0073958 | 3/1994 | Germany . | |
| 2450 | of 1891 | United Kingdom | 81/92 |
| 0026212 | of 1913 | United Kingdom . | |

*Primary Examiner*—D. S. Meislin

*Attorney, Agent, or Firm*—Kelly Bauersfeld Lowry & Kelley, LLP

[57] ABSTRACT

A tool is provided which is useful for loosening the locking collars of frangible fasteners which are commonly used in the aerospace industry. The tool includes a socket head having a through socket at one end thereof, an elongated handle having a jaw end forming an arcuate surface, and an assembly pin which extends through aligned handle and socket head apertures to pivotally attach the handle to the socket head. Two sets of gripping teeth are provided within the socket in an adjoining arrangement to one another along a longitudinal axis of the socket. The jaw end of the handle projects into the socket to grasp items therein, such as the narrow wall of a locking collar of a frangible fastener. Preferably, the arcuate surface of the handle forms an involute curve.

10 Claims, 1 Drawing Sheet

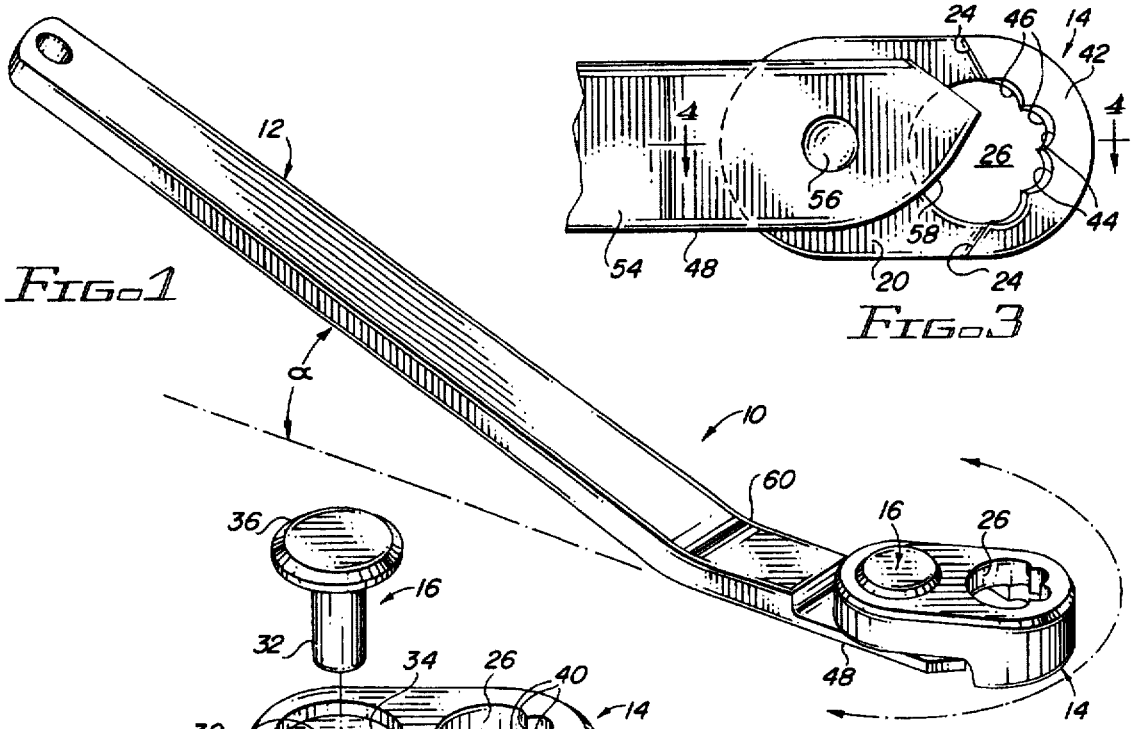
FIG. 1
FIG. 3
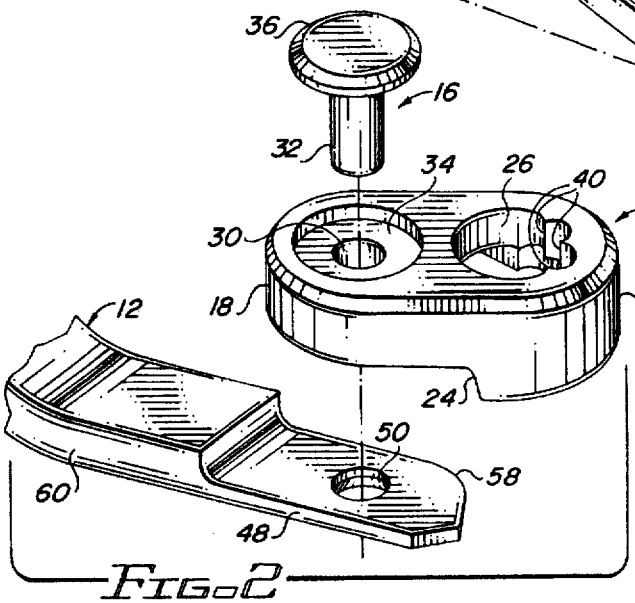
FIG. 2
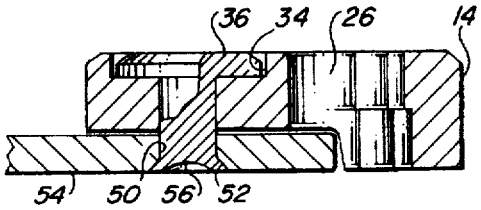
FIG. 4
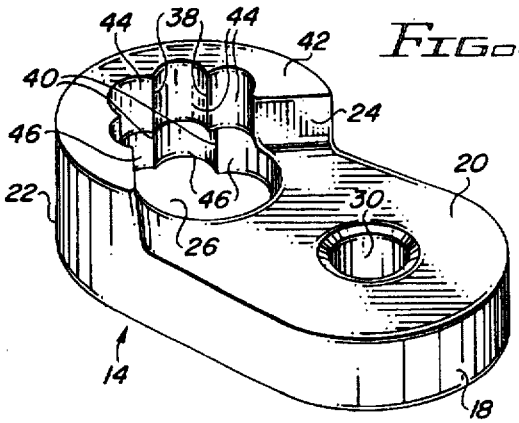
FIG. 5
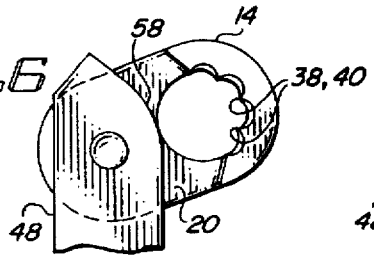
FIG. 6
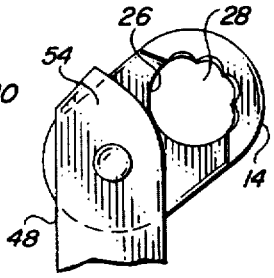
FIG. 7
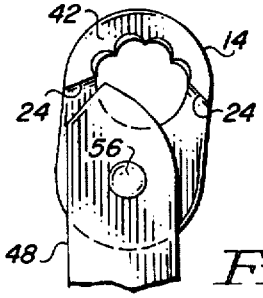
FIG. 8

HAND WRENCHING TOOL FOR REMOVING TORQUE LIMITED FASTENERS

BACKGROUND OF THE INVENTION

This invention relates to wrenching tools. More specifically, the present invention relates to a hand tool useful for the removal of torque limited fasteners.

Frangible fasteners are used extensively in the aerospace industry. These fasteners employ a threaded nut member which has a threaded collar, and a wrenching ring. The threaded nut member and the wrenching ring are joined together by a neck with a notched section which shears from the collar when the applied torque exceeds a predetermined torsional loading. Often the threaded collar has an upset portion, usually a slightly elliptical shape, to provide a frictional spring lock that prevents the fastener from spinning off in the event that the residual tension on the fastener is lost. Such fasteners are applied with wrenching tools which engage the wrenching ring to apply the threaded collar, and which twist the wrenching ring from the threaded collar when the predetermined torsional loading is exceeded.

It is frequently desirable to loosen or remove the threaded collar from the assembled fastener. The threaded collar commonly has a cylindrical base which tapers into a smaller diameter cylindrical neck. The cylindrical portions of such collars are narrow and are difficult to grasp with conventional tools such as pliers and Vise Grip clamps, etc. Additionally, the use of non-standard tools for loosening or removing of the frangible fastener is objectionable as such tools can damage the surfaces of the assembled parts.

Accordingly, there has been a need for a hand wrenching tool which is of very simple design, and yet efficiently serves the purpose of loosening and removing the fasteners that are commonly utilized in the aerospace industry. The present invention fulfills these needs and provides other related advantages.

SUMMARY OF THE INVENTION

The present invention resides in a hand wrenching tool for removing torque limited fasteners, such as the locking collars of frangible fasteners which are commonly used in the aerospace industry. The hand wrenching tool comprises, generally, a socket head having a through socket at one end thereof and an aperture through another end, an elongated handle having a jaw end forming an arcuate surface, and an assembly pin which pivotally attaches the handle to the socket head. A first set of teeth form a portion of a wall for the socket, and a second set of teeth form another portion of the wall for the socket, wherein the second set of teeth adjoin the first set of teeth along a longitudinal axis of the socket. The handle includes an aperture aligned with the socket head aperture, through which the assembly pin extends. When properly assembled, the arcuate surface of the handle rotates into the socket to grip a portion of a torque limited fastener between one or both sets of teeth and the handle.

In a preferred form of the invention, the socket head includes a first end of a first thickness and an opposite end of reduced thickness providing a planar land with a vertical shoulder between the planar land and a planar lower surface of the first end. The through socket is traversed by the vertical shoulder to provide an open central area of the shoulder which is open to the socket. The jaw end of the elongated handle has a thickness which is substantially equal to the reduction of thickness of the socket head, and one side of the jaw end is received on the planar land. The handle includes a bend intermediate its length to permit placement of the jaw end of the handle flush against a work surface while providing hand gripping clearance. The arcuate surface of the handle further forms an involute curve.

The first set of teeth has an edge joining a lower surface of the socket head. The wall of the through socket of the through socket formed thereby defines semi-cylindrical cut-outs each having a first radius of curvature. The first set of teeth are formed at common edges of adjacent semi-cylindrical cut-outs.

The wall portion of the through socket formed by the second set of teeth also defines semi-cylindrical cut-outs, each having a second radius of curvature. The second set of teeth are formed at common edges of adjacent semi-cylindrical cut-outs. The second radius of curvature is greater than the first radius of curvature.

Other features of the present invention will become apparent from the following more detailed description, taken in conjunction with the accompanying drawings which illustrated, by way of example, the principles of the invention.

BRIEF DESCRIPTION OF THE DRAWINGS

The accompanying drawings illustrate the invention. In such drawings:

FIG. 1 is a front, side and top perspective view of a hand wrenching tool embodying the present invention;

FIG. 2 is an enlarged exploded perspective view of a working end of the hand wrenching tool of FIG. 1;

FIG. 3 is an enlarged, fragmented bottom plan view of the working end of the hand wrenching tool of FIGS. 1 and 2;

FIG. 4 is a sectional view taken generally along the line 4—4 of FIG. 3;

FIG. 5 is a bottom, side and rear perspective view of a socket head forming a portion of the hand wrenching tool of the present invention;

FIG. 6 is a bottom plan view similar to that illustrated in FIG. 3, illustrating the angular relationship between a tool handle and the socket head when the socket head is first placed over a threaded collar of a torque limited fastener;

FIG. 7 is a bottom plan view similar to FIG. 6, illustrating rotation of the handle relative to the socket head to engage a large fastener; and FIG. 8 illustrates rotation of the handle relative to the socket head so as to place an arcuate surface of the tool head into contact with a smaller diameter fastener.

DETAILED DESCRIPTION OF THE PREFERRED EMBODIMENT

As shown in the drawings for purposes of illustration, the present invention is concerned with a hand wrenching tool, generally designated in the accompanying drawings by the reference number 10. The wrenching tool 10 comprises, generally, an assembly of a handle 12 and a socket head 14 which is secured by a pin 16.

The socket head 14 has a reduced thickness portion at an end 18 formed with a planar surface land 20, and a full thickness portion at an end 22 with a shoulder or step 24 between the two portions. The socket head 14 has a through socket 26 which is traversed by the shoulder 24 to provide a central area 28 which is open to the socket 26. The reduced thickness end 18 has a single through aperture 30 which loosely receives a shank portion 32 of the pin 16 therethrough for the purpose of pivotally securing the assembly of the handle 12 to the socket head 14. A countersunk recess 34 is provided on an upper surface of the socket head 14 about the aperture 30, for receiving a headed end 36 of the pin 16.

The inside wall of the socket 26 includes a first portion forming a first set of teeth 38 within the socket, and a second portion forming a second set of teeth 40. The first and second sets of teeth 38 and 40 adjoin one another along a longitudinal axis of the socket 26. More particularly, the first set of teeth 38 has an edge adjoining a lower surface 42 of the socket head 14. The first set of teeth 38 are defined by semi-cylindrical cut-outs 44 having a radius of curvature of approximately 0.0465 inch. The first set of teeth 38 are formed at common edges of adjacent semi-cylindrical cut-outs 44. The wall portion of the through socket 26 forming the second set of teeth 40 defines a second set of semi-cylindrical cut-outs 46 which have a radius of curvature of approximately 0.0625 inch. The second set of teeth 40 are formed at the common edges of adjacent ones of the semi-cylindrical cut-outs 46. Further the radius of curvature of the cut-outs 46 for the second set of teeth 40, is greater than the radius of curvature for the first set of cut-outs 44. This particular arrangement facilitates gripping by the socket head 14 of the base of a frangible fastener.

The handle 12 is an elongated bar having a reduced-thickness jaw end 48 which is placed adjacent to the planar land 20 of the socket head 14. A through aperture 50 is provided in the jaw end 48 that is aligned with the aperture 30 of the socket head 14. The shank portion 32 of the pin 16 is press fit through the aperture 50 to pivotally secure the pin 16 to the socket head 14. A countersunk recess 52 is provided in a lower surface 54 of the jaw end 48 for receiving a locking flair 56 of the pin 16. When assembled, the lower surface 54 of the pin 16 is preferably coplanar with the lower surface 42 of the socket head 14.

The jaw end 48 of the handle 12 further includes a smooth arcuate surface 58 which forms an involute curve. As such, the arcuate surface 58 has no set radius, however, the pivot point for the involute curve forming the arcuate surface 58 is offset from the center of the aperture 50.

The handle 12 has a slight bend 60 intermediate its length. The bend in the handle permits placement of the jaw end 48 of the handle 12 flush against a work surface while providing hand gripping clearance.

FIG. 6–8 illustrate the assembled hand wrenching tool 10 with various positions of the socket head 14 in the assembly. FIG. 6 illustrates the socket head 14 in its full open position (rotated at an angle of approximately 60° or greater relative to the longitudinal axis of the handle 12). The socket head 14 in this position has the through socket 26 unencumbered by any portion of the jaw end 48 of the handle 12. In FIG. 7, the socket head 14 is rotated to an angle of approximately 45° with the longitudinal axis of the handle 12. Since the nominal radius of the involute curve of the arcuate surface 58 of the jaw end 48 of the handle 12 is greater than the distance between the through aperture 50 and the open central area 28 of the shoulder 24, the rotation of the socket head will advance the arcuate surface 58 into the socket 26 and into a position to be in locking relationship to a fastener body received in the socket. FIG. 8 illustrates the hand wrenching tool 10 in its position to lock the smallest diameter fastener with which it can be used. In this illustration, the socket head 14 is rotated to a position approximately coaxial with the longitudinal axis of the handle 12.

In use, the hand wrenching tool 10 is designed to receive within its socket 26 the narrow cylindrical base of the fastening collar of a torque limited fastener. The cylindrical fastening collar is securely engaged by one or both sets of teeth 38 and 40 on the inside wall of the socket 26, and is locked thereto by the arcuate surface 58 of the jaw end 48 of the handle 12. When properly positioned, counterclockwise rotation of the handle 12 will forcefully rotate the fastening collar, securing its removal. During the operation, the jaw end 48 of the handle 12 is flush with the surface of the work piece. The bend 60 of the handle provides clearance for gripping the handle by the user.

From the foregoing it is to be appreciated that the hand wrenching tool 10 of the present invention is of very simple design, yet efficiently serves the purpose of loosening and removing torque limited fasteners commonly utilized in the aerospace industry. The use of separate sets of teeth adjoining one another along a longitudinal axis of the through socket 26, together with an involute curve-forming arcuate surface on the jaw end of the handle 12, insures that a locking collar having a cylindrical wall of limited thickness can be securely engaged by the wrenching tool 10, permitting the application of a sufficient torque to loosen the fastener.

Although a particular embodiment of the invention has been described in detail for purposes of illustration, various modifications may be made without departing from the spirit and scope of the invention. Accordingly, the invention is not to be limited, except as by the appended claims.

I claim:

1. A hand wrenching tool for removing torque limited fasteners, comprising:

a socket head including a through socket at one end thereof, an aperture through another end, a first set of teeth forming a portion of a wall for the socket, and a second set of teeth forming another portion of the wall for the socket, wherein the second set of teeth adjoin the first set of teeth along a longitudinal axis of the socket;

an elongated handle having a jaw end forming an arcuate surface, and an aperture aligned with the socket head aperture; and an assembly pin extending through the aligned handle and socket head apertures, to pivotally attach the handle to the socket head;

wherein the first set of teeth has an edge adjoining a lower surface of the socket head, and the wall portion formed thereby defines semi-cylindrical cutouts each having a first radius of curvature, whereby the first set of teeth are formed at common edges of adjacent semi-cylindrical cut-outs;

wherein the wall portion formed by the second set of teeth defines semi-cylindrical cut-outs each having a second radius of curvature, whereby the second set of teeth are formed at common edges of adjacent semi-cylindrical cutouts; and wherein the second radius of curvature is greater than the first radius of curvature.

2. The tool of claim 1, wherein the arcuate surface of the handle forms an involute curve.

3. The tool of claim 1, wherein the socket head includes a first end of a first thickness and an opposite end of a reduced thickness providing a planar land with a vertical shoulder between the planar land and a planar lower surface of the socket head first end, wherein the through socket is traversed by the vertical shoulder to provide an open central area of the shoulder which is open to the socket, and wherein the jaw end of the elongated handle has a thickness which is substantially equal to the reduction of thickness of the socket head, and one side of the jaw end is received on the planar land.

4. The tool of claim 3, wherein the handle includes a bend intermediate the length thereof to permit placement of the jaw end of the handle flush against a work surface while providing hand gripping clearance.

5. A hand wrenching tool for removing torque limited fasteners, comprising:

a socket head including a through socket at one end thereof and an aperture through another end, wherein a first portion of a wall for the socket comprises a first irregular shape forming a first set of teeth within the socket, and wherein a second portion of the wall for the socket adjacent to the first portion along a longitudinal axis of the socket comprises a second irregular shape forming a second set of teeth;

a handle having a jaw end forming an arcuate surface of an involute curve, and an aperture aligned with the socket head aperture; and means for pivotally attaching the handle to a socket head, to permit the arcuate surface of the handle to rotate into the socket;

wherein the first set of teeth has an edge adjoining a lower surface of the socket head, and the wall portion formed thereby defines semi-cylindrical cut-outs each having a first radius of curvature, whereby the first set of teeth are formed at common edges of adjacent semi-cylindrical cut-outs:

wherein the wall portion formed by the second set of teeth defines semi-cylindrical cut-outs each having a second radius of curvature, whereby the second set of teeth are formed at common edges of adjacent semi-cylindrical cut-outs: and wherein the second radius of curvature is greater than the first radius of curvature.

6. The tool of claim 5, wherein the socket head includes a first end of a first thickness and an opposite end of a reduced thickness providing a planar land with a vertical shoulder between the planar land and a planar lower surface of the socket head first end, wherein the through socket is traversed by the vertical shoulder to provide an open central area of the shoulder which is open to the socket, and wherein the jaw end of the handle has a thickness which is substantially equal to the reduction of thickness of the socket head, and one side of the jaw end is received on the planar land.

7. The tool of claim 6, wherein the handle includes a bend intermediate the length thereof to permit placement of the jaw end of the handle flush against a work surface while providing hand gripping clearance.

8. A hand wrenching tool for removing torque limited fasteners, comprising:

a socket head including a through socket at one end thereof, an aperture through another end, a first set of teeth forming a portion of a wall for the socket, and a second set of teeth forming another portion of the wall for the socket, wherein the second set of teeth adjoin the first set of teeth along a longitudinal axis of the socket, a first end of a first thickness and an opposite end of a reduced thickness providing a planar land with a vertical shoulder between the planar land and a planar lower surface of the first end, wherein the through socket is traversed by the vertical shoulder to provide an open central area of the shoulder which is open to the socket, wherein the first set of teeth has an edge adjoining a lower surface of the socket head and the wall portion formed thereby defines semi-cylindrical cut-outs each having a first radius of curvature, whereby the first set of teeth are formed at common edges of adjacent semi-cylindrical cut-outs, and wherein the wall portion formed by the second set of teeth defines semi-cylindrical cut-outs each having a second radius of curvature, whereby the second set of teeth are formed at common edges of adjacent semi-cylindrical cut-outs and wherein the second radius of curvature is greater than the first radius of curvature;

an elongated handle having a jaw end forming an arcuate surface, and an aperture aligned with the socket head aperture, wherein the jaw end of the elongated handle has a thickness which is substantially equal to the reduction of thickness of the socket head, and one side of the jaw end is received on the planar land; and an assembly pin extending through the aligned handle and socket head apertures, to pivotally attach the handle to the socket head and permit the arcuate surface of the handle to rotate into the socket.

9. The tool of claim 8, wherein the handle includes a bend intermediate the length thereof to permit placement of the jaw end of the handle flush against a work surface while providing hand gripping clearance.

10. The tool of claim 8, wherein the arcuate surface of the handle forms an involute curve.

* * * * *